US005795054A

United States Patent [19]

Booty, Jr.

[11] Patent Number: 5,795,054

[45] Date of Patent: Aug. 18, 1998

[54] GUARDLIGHT

[75] Inventor: Donald J. Booty, Jr., Chicago, Ill.

[73] Assignee: Phorm Concept & Design, Inc., Chicago, Ill.

[21] Appl. No.: 811,881

[22] Filed: Mar. 5, 1997

[51] Int. Cl.[6] ..... F21V 33/00

[52] U.S. Cl. ..... 362/96; 362/109; 362/186; 222/162

[58] Field of Search ..... 362/96, 109, 102, 362/186, 253; 222/113, 162, 402.11, 192

[56] References Cited

U.S. PATENT DOCUMENTS

| | | | |
|---|---|---|---|
| 3,716,170 | 2/1973 | Mangels | 222/162 |
| 3,776,429 | 12/1973 | DeLucia | 222/162 |
| 3,810,250 | 5/1974 | McGregor | 362/96 |
| 4,247,844 | 1/1981 | Zapolski et al. | 340/321 |
| 5,086,377 | 2/1992 | Roberts | 362/102 |
| 5,307,249 | 4/1994 | Vanwynsberghe | 362/96 |
| 5,331,523 | 7/1994 | Delzer | 362/96 |
| 5,373,427 | 12/1994 | McLean | 362/96 |
| 5,420,766 | 5/1995 | Hollis | 362/96 |
| 5,446,985 | 9/1995 | Chen | 362/96 |

FOREIGN PATENT DOCUMENTS 893344 4/1962 United Kingdom .

*Primary Examiner*—Alan Cariaso
*Attorney, Agent, or Firm*—Richard C. Litman

[57] ABSTRACT

A flashlight is combined with either a pepper spray or a sonic alarm as a defensive device against an attack by either a human or an animal assailant. A secondary light outlet provides an illumination in the direction of the defensive spray or the sonic alarm source which are positioned perpendicular to the primary light source. A sliding collar serves as a protective cover over the actuator button of the spray or alarm. The guardlight is compact and conveniently carried in a purse or coat pocket. In an emergency, the half-groove, half-rib design of the elliptical shaped handle permits correct orientation of the guardlight by only a tactile sense by the user. A finger-guard on the handle protects the user's hand from protruding into the line of the defensive spray.

20 Claims, 4 Drawing Sheets

GUARDLIGHT

BACKGROUND OF THE INVENTION

1. Field of the Invention

The present invention relates to a guardlight made up of a flashlight combined with either a sonic alarm or a pepper spray device. A second illumination outlet is provided simultaneously with the frontal light at 90°. The nozzle of the sonic alarm or the pepper spray device is located alongside the second illumination outlet and actuated by a push button positioned on an opposite side and protected by a movable collar.

2. Description of the Prior Art

The prior art describes various aerosol spray and/or sound emitting devices combined with a lamp for defense and an apparatus for the repelling of assailants. The prior art will be described in the order of their perceived relevance.

U.S. Pat. No. 5,086,377, issued to Bert Roberts on Feb. 4, 1992, describes a lengthy baton or night stick which combines a flashlight on one end, an aerosol defense spray, and a compartment for storing personal property in the hand-gripping mid-section, and either an audible alarm or another high intensity flashlight at the other end. The spray is emitted perpendicular to the light beam and activated by a slide switch located on the opposite side of the baton from the spray. The lamp and the audio alarm have separate batteries. Maximum efficiency of the audible alarm is not seen when the alarm is directed backwards towards the user when the headlamp is directed towards the attacker. The length, the holding strap and bicycle clips of the baton are significant disadvantages because the baton cannot be carried in a pocket or purse. The present invention provides a small device which has a shape and external ridges which enable the user to immediately position the guardlight in the user's hand for action.

U.S. Pat. No. 5,420,766, issued to Bob J. Hollis on May 30, 1995, describes a flashlight combined with an alarm having two speakers and an incapacitating spray dispenser which are housed in an enlarged head, and the batteries housed in a tubular handle. The spray and alarm are activated by the same button. A safety switch prevents activation of the alarm and spray when the lamp is off. The large forward housing and a breakaway strap at the opposite end of the defensive light device are designed to protect the user when attacked by an assailant. This device differs significantly from the present invention which permits the use of the incapacitating spray or alarm independent from the light source. Another difference is the relative size of the defensive light devices, in that Hollis' bulky device could not readily be kept in a coat pocket, purse or a vehicle's glove compartment.

U.S. Pat. No. 4,247,844, issued to Bronislaw Zapolski et al. on Jan. 27, 1981, describes a combination alarm and flashlight device having above the lamp a movable actuator or switch which houses a vibratable disk. The actuator can independently energize the lamp and the alarm via a propellant tank or optionally energize both simultaneously with a further modification of the movable actuator. The actuator can be locked in the alarm mode by an optional locking button. The significant difference in the present invention lies in the fact that the alarm or spray mode cannot be locked because these defensive devices should be under the immediate control of the user. The locking button involves the time-consuming added motion by the user to depress the button and move the thumb to push the actuator forward to the unlocking position.

U.S. Pat. No. 5,373,427, issued to Roderick G. McLean on Dec. 13, 1994, describes a combination flashlight and a spray for self-defense having a segmented switch. The lamp is positioned above the spray aperture, and both elements are perpendicular to the axis of the handle. An articulating lever of the switch activates the light source while either preventing or allowing access to the spray canister. Flipping up the articulating lever enables access to an actuating lever of the spray canister. The significant differences lie in the perpendicular position of the lamp relative to the handle and the added inconvenience and time-consuming motion in lifting the lower portion of the segmented switch to gain access to the lever which lies in a cavity in order to actuate the spray.

U.S. Pat. No. 3,716,170, issued to Ralph W. Mangels on Feb. 13, 1973, describes a flashlight which ejects a pressurized chemical spray within the pattern of the illumination. The light and the chemical spray can be directed along the longitudinal axis of the handle or perpendicular thereto in separate embodiments. In the first embodiment, the center of the circular shaped front head portion of the flashlight casing is offset upwardly on the vertical center line from the horizontal center of the tubular barrel portion in order to cause the flashlight to lay in an upright position when at rest to allow a quick pickup. A significant difference is that the gas is ejected through a small tube which intersects the reflector and the lens. Two adjacent separate switches are provided to activate the gas spray and the light. There is no provision for protecting the gas spray switch.

U.S. Pat. No. 3,776,429, issued to John R. DeLucia on Dec. 4, 1973, describes a combination flashlight and a propellant discharge device which incorporates a three-position switch. The first or off position deactivates the device. The second position energizes the light bulb. The third position discharges the propellant from a capsule. An interlock element prevents discharge of the propellant when the switch is in the first and second positions. The gas is directed in the direction of the light beam and issues from an orifice located above the reflector. A significant difference is the Involved operation of a three-position switch with the DeLucia invention.

U.S. Pat. No. 5,307,249, issued to Dennis S. Vanwynsberghe on Apr. 26, 1994, describes a combination flashlight and repellant spray device which ejects the repellant above the lens from a canister located either in the rear or on top of the tubular body. The light switch which is located on one side of the tube is only convenient for a right-handed user. The valve actuator button is protected by a hinged valve cover and located on the top of the handle proximate to the light switch. Significant differences appear to be a small capacity repellant container and the difficulty in operating the release of the hinged valve cover which has a small lip.

U.S. Pat. No. 5,331,523, issued to David G. Delzer on Jul. 19, 1994, describes a gas dispensing flashlight having a primary housing for the flashlight with a secondary housing for the gas dispenser located below the flashlight handle. Three gas ports are located in a position to direct the nerve reacting gas or teargas in the same direction as the light beam. The flashlight on/off switch is located on a side of the flashlight handle suitable only for a right handed user's thumb, whereas the gas actuator switch button is located at the rear of the secondary housing and underneath the handle. A safety side rod is provided orthogonal to the gas actuator switch button to lock the button and must be pushed in from one side to unlock the button. This safety feature requires undue valuable time in order to activate the gas flow during a surprise attack.

U.K. Patent No. 893,344, published for Lam L. Fal on Apr. 11, 1962, describes two lamp filaments inside a flashlight or electric torch lamp bulb to provide illumination with either a wide angle or a narrow angle. There is no disclosure providing illumination in a separate direction.

All the cited prior art patents fail to suggest a second light outlet in the direction perpendicular to the direction of the primary light, and a slidable collar element which protects and permits independent operation of the light source and tie spray or sonic alarm device.

The disclosures of the prior art discussed above are hereby incorporated by reference. None of the above patents, taken either singly or in combination, is seen to describe the instant invention as claimed.

SUMMARY OF THE INVENTION

Accordingly, it is a principal object of the invention to provide a guardlight comprising a flashlight combined with either a sonic alarm or a pepper spray device.

It is another object of the invention to provide a second illumination outlet at 90° to the frontal light source.

It is a further object of the invention to provide the nozzle of either the sonic alarm or pepper spray device alongside the second illumination source.

Still another object of the invention is to provide a sliding collar which protects activation of either the sonic alarm or the pepper spray.

It is yet a further object of the invention to provide a guardlight having multiple functional parameters, yet which is extremely small, lightweight and of optimum simplicity in using.

It is an object of the invention to provide improved elements and arrangements thereof in an apparatus for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a flashlight combined with either a pepper spray or a sonic alarm as a defensive device against a surprise attack by either a human or animal assailant. A secondary light outlet is provided by forming an aperture in the parabolic lens of the first or primary light source to illuminate the region in the direction of the defensive spray or alarm. The secondary light outlet and defensive spray or alarm are positioned perpendicularly to the axis of the flashlight tube. A sliding collar covers the large activating push-in switch for the spray or alarm to prevent inadvertent activation and is frictionally kept in position by tabs on the body. A separate sliding light switch is provided adjacent to the primary light source. The flashlight body is purposely designed to enable the user to grasp the defensive device and locate the activating switches readily by tactile sense. The elliptically shaped body has a half-groove and half-rib pattern which readily orients the flashlight for the user while resting in a pocket or purse. The feature of a projecting lip proximate to the spray nozzle is for the protection of the user's hand when the defensive spray is activated. The user has the option of loading the guardlight with either a pepper spray dispenser or a sonic alarm dispenser encased in a separate holder The nozzle for each dispenser is advantageously maintained in the body. The emphasis of the invention is upon the smaller size, immediate positioning of the hand for activation, and the predetermined alternative choice of repellant available to the user.

Figure 1:
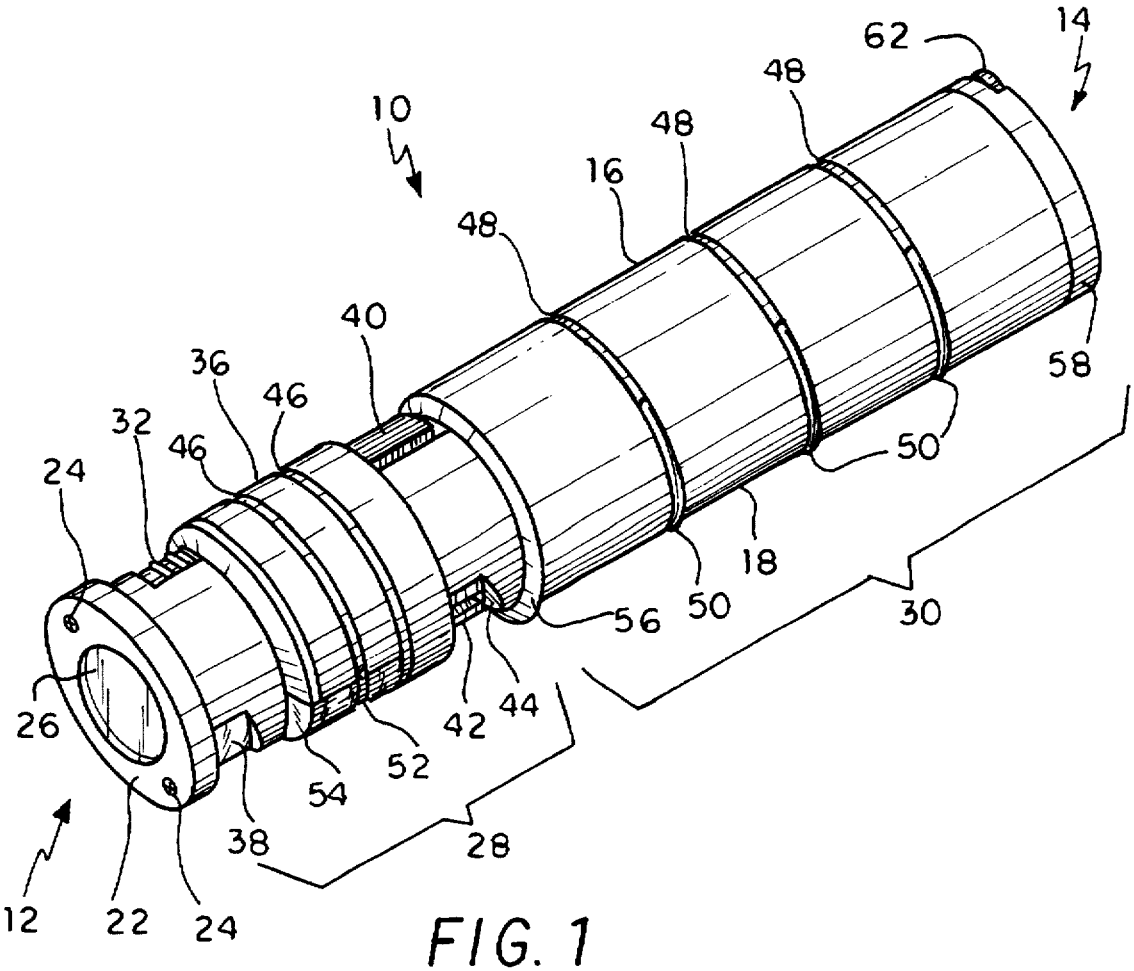
FIG. 1 is a perspective view of the guardlight.

In FIG. 1, a guardlight 10 having a front end 12 and a rear end 14 is illustrated. For purposes of identifying the locations of various features of the guardlight 10, a curved top surface 16, a curved bottom surface 18, and curved side surfaces 20 are delineated. The front end 12 includes a lens cover 22 fastened by two screws 24 and nuts 25 (see FIG. 3). The transparent and plastic primary front lens 26 is enclosed by the lens cover 22.

A recessed elliptical collar section 28 is formed between the lens cover 22 and the handle section 30. The lens cover 22, collar 36 and the handle section 30 have the same cross-sectional and external elliptical shape. On the top surface 16 proximate to the lens cover 22 is the corrugated lamp switch 32 which slides forward when activating the lamp 34 depicted in FIG. 4.

A collar 36 is illustrated purposely in an intermediate position in FIG. 1 to reveal the locations of the corrugated lamp switch 32, the curved secondary light lens 38, and the smooth-surfaced push-down or depressible switch 40 for activating the repellant device to either expel the gas or emit the sonic alarm from the nozzle 42. It should be noted that the difference in the respective surfaces of the lamp switch 32 and depressible switch 40 permits immediate identification of which guardlight function is desired. Moreover, the respective switches require different activating thumb motions, i.e., sliding vs. depressing.

Since the nozzle 42 is located on the bottom surface 18 in a recess 44 on the bottom surface 18 opposite from the push-down switch button 40, this configuration of the relative positions of the depressible switch 40 and the nozzle 42 enables the user to quickly slide the collar 36 forward with a thumb while maintaining a grip on the handle section 30, aim the nozzle 42 at the attacker by twisting the wrist, and depress the elongated switch button 40 with the thumb to activate the repellant ejection in a matter of seconds. In effect, the operation is a simple one-thumb procedure for either a right-handed or left-handed user.

Collar 36 has two circumferential grooves 46 which are readily distinguishable to the user from the handle section 30 which has a different surface identification. The handle section 30 has three grooved regions 48 on the curved top surface 16 changing to ridged regions 50 on the curved bottom surface 18 at a midpoint on the curved side surfaces 20.

The collar 36 has a curved and grooved third or ternary lens 52 placed in the lower edge region proximate to the secondary lens 38 to enable the two lens to overlap, thus continuing to permit the secondary source of illumination in the direction of the attacker. Grooves 54 are formed on the inside surface of the third lens 52 running in a longitudinal direction in order to better collimate and direct the light rays emitted by the lamp 34.

On the lower portion of the handle section 30 proximate to nozzle 42, a shoulder guard 56 is formed to indicate to the user not to position a finger over the nozzle 42 and to protect the repellant spray from contacting the user's finger.

End cap 58 of the guardlight 10 has a hinge 60 (FIG. 2) for loading batteries 70 and the gas canister 76 with its holder 78. The end cap 58 is secured by a fastener (bolt) 62.

Figure 2:
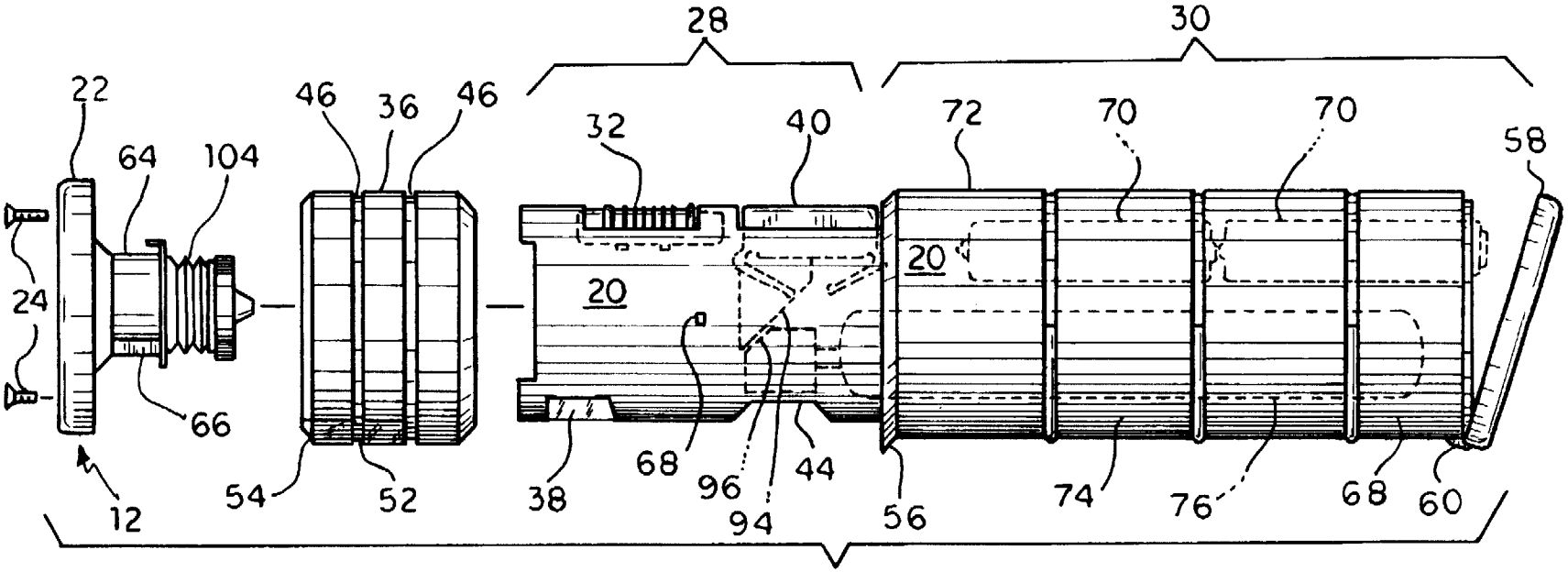
FIG. 2 is an exploded side view of the guardlight.

In the exploded view in FIG. 2, the novel modification of the reflector 64 to provide a rectangular aperture 66 for the illumination of the second light outlet is illustrated. Instead of providing a second lamp means, it has been found that this novel modification provides adequate illumination for the user by the krypton gas-filled lamp 34 to view the approaching attacker while activating the repellant or alarm.

The collar 36 is conveniently frictionally locked in either position whether covering the push-down button switch 40 or covering the flashlight lamp switch 32 by two locking tabs 68 positioned on the opposite side surfaces 20 equidistant from the lens cover 22 and the shoulder guard 56. Minimal effort is required to move the collar 36 from one position to the other, but adequate resistance is maintained by the locking tabs 68 to prevent the collar 36 from sliding to an unlocked position.

Figure 6:
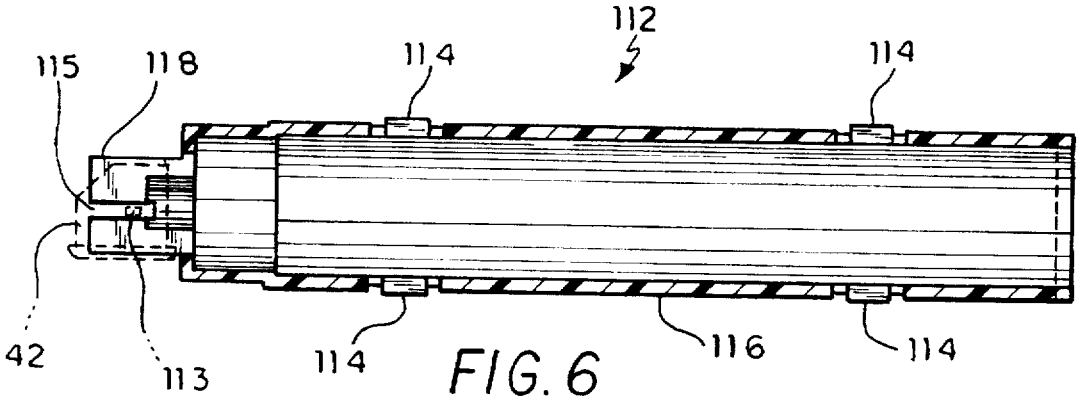
FIG. 6 is a side view of the spray canister holder in section with a spray nozzle.

Four AAA batteries 70, preferably alkaline or rechargeable, are grouped together in an upper chamber 72 of the guardlight handle 30 (only two batteries 70 are shown in dashed or shadow outlines in the side view). In the lower chamber 74, a gas-containing canister 76 (in dashed outline without its holder or container 78 which is illustrated in FIG. 6) of either pepper gas or a pressurized gas such as carbon dioxide for the sonic alarm is positioned. Other disabling repellents such as MACE (TM), teargas, carbon disulfide, or the like can be substituted for the pepper gas. The batteries 70 and the canister 76 are confined in their respective chambers 72 and 74 by projecting ribs on the inside of each chamber. These confining ribs are not shown in the drawings to better illustrate the more important features of the invention.

Figure 3:
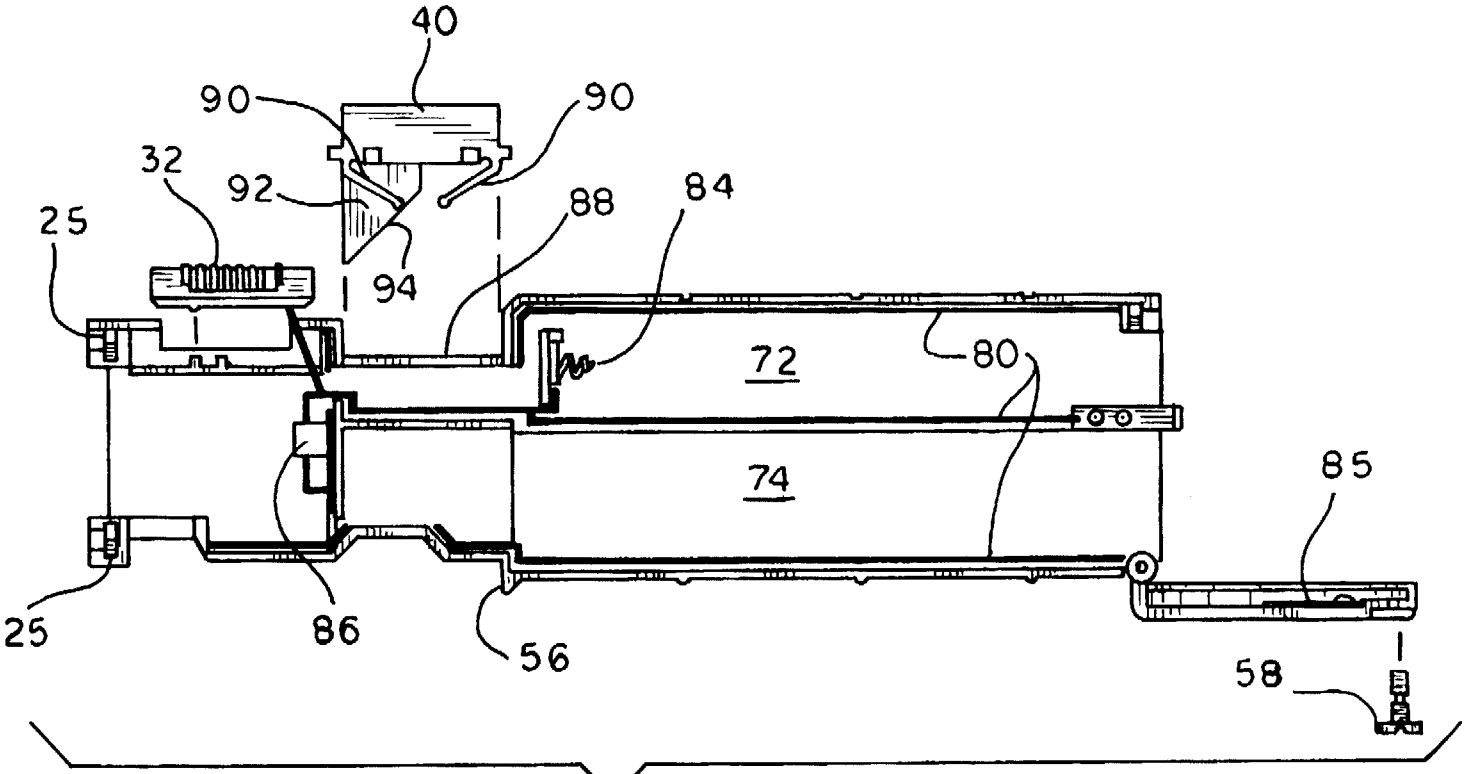
FIG. 3 is an exploded side view of the guardlight, and further drawn partially in section.

Turning to FIG. 3, a partial sectional view of the guardlight casing is illustrated with solid depictions of the sliding lamp switch 32, the push-down repellant button 40, the electrical wiring 80 (solid lines), the lamp contact 86, the forward battery terminal contact spring 84, and the rear battery contact plate 85. The repellant button 40 is confined and configured to be depressed into a button recess 88 by two flexible depressible legs 90. The button has a narrowed and angled block portion 92 which penetrates the interior via an aperture (not shown) in the flat top surface of the recess 88 of the reduced elliptical collar section 28 (FIG. 1). The 45° angled surface 94 of the block portion 92 contacts the cooperating 45° angled surface 96 of the plastic nozzle 42 (FIG. 2) and pushes the nozzle 42 rearward to cause the conventional valve of the canister 76 to open and release the pressurized gas.

Figure 4:
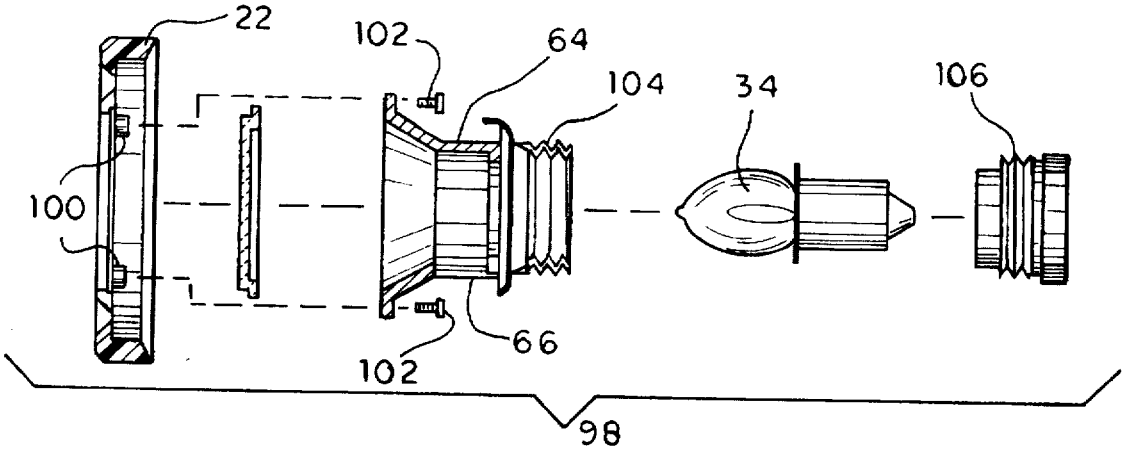
FIG. 4 is an exploded side view of the main light assembly, and further drawn partially in section.

Turning to FIG. 4, the exploded schematic side view of the main light assembly 98 shows the lens cover 22 with four projecting bosses 100 arranged equidistantly apart (only two bosses shown) which accommodate screw fasteners 102 to confine the frontal lens 26 between the lens cover 22 and the reflector 64. The unique reflector 64 has a rectangular aperture 66 as explained above to permit a secondary illumination for the repellant. The reflector 64 is integrated with a female threaded lamp base portion 104 into which is inserted the lamp 34 and held by the male threaded base plug 106.

Figure 5:
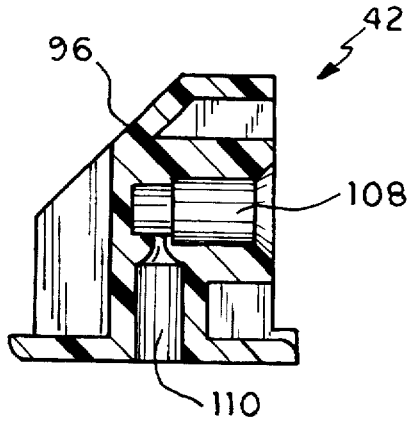
FIG. 5 is a sectional view of the spray nozzle.

FIG. 5 shows a sectional view of the spray or alarm nozzle 42 having the cooperating 45° angled surface 96. The valve portion of the gas canister 76 fits snugly in the valve containment portion 108 which connects with the orifice 110 permitting the ejection of the compressed gas or fluid.

FIG. 6 is a side view of the plastic gas canister holder 112 in section to illustrate the positioning of the nozzle 42 having projecting tabs 113 on each side (in shadow), which tabs are confined in slots 115 of the parallel brackets 118. Only one bracket is illustrated. The cylindrical holder 112 is formed from two halves with four releasable apertured loops (not shown) on one half which fit over cooperating projecting tabs 114 on the other half 116. Therefore, the gas canister 76 (not shown) is loaded by closing the holder 112 with the cooperating loops and projecting tabs 113 and inserting the holder from the rear end 14 of the lightguard 10.

The guard unit 10 is small enough to be carried unobtrusively on a person and readily oriented by the person for use due to the half-ribbed handle section 30. The collar 36 guarding the depressible repellant switch button 40 can be moved forward with a minimum of effort to expose the elongated button and yet permit the second illuminating light to be directed towards the attacker.

Exemplary dimensions and features of the guardlight are as follows:

Flashlight body: 6.5 in. (16.5 cm.) long; elliptical cross-section, 1 5/8 in. (4 cm.) by 1.25 in. (3.2 cm.); black acrylonitrile-butadiene-styrene polymer.

Collar: 1 1/8 in. (2.8 cm.) wide. Frontal lens: Flat acrylic polymer; diameter, 7/8 in. (2.2 cm.).

Frontal lens: Flat acrylic polymer, diameter 7/8 in. (2.3 cm.).

Side lens: Curved acrylic polymer with longitudinal diffracting lines; 13/16 in. (2.1 cm.) by 11/16 in. (1.8 cm.).

Flashlight bulb: Krypton gas filled.

Battery: Four AAA.

Red pepper aerosol repellant: Oleoresin red pepper, 1,500,000 Scoville Heat Units.

It is to be understood that the present invention is not limited to the sole embodiment described above, but encompasses any and all embodiments within the scope of the following claims.

I claim:

1. A guardlight comprising:

a body with a predetermined configuration, and having a frontal lens section, a uniformly recessed collar section, and a handle section;

said frontal lens section including:

a lens cover containing a flat primary lens, a parabolic reflector with a rectangular aperture in its bottom surface, and a lamp; said recessed collar section including:

a sliding lamp switch on a top surface proximate to said frontal lens section for activating said lamp;

a depressible button switch on a top surface proximate to said handle section for activating an ejection of gas;

a curved secondary light lens on a bottom surface positioned proximate to said frontal lens section;

an aperture on said bottom surface positioned proximate to said handle section and contiguous to a spray nozzle means;

and a slidable collar having a curved ternary light lens positioned at its forward edge and on its bottom surface; and said handle section including:

batteries enclosed in an upper chamber of said handle section;

a gas cylinder having a gas valve means enclosed in a lower chamber of said handle section; and an end cap enclosing said upper and lower chambers;

whereby a user can defend against an attack by an assailant by sliding said lamp switch forward to activate the lamp, sliding said collar forward to expose said depressible button switch while tilting the lightguard up to illuminate and to activate the ejection of gas from said gas cylinder by depressing said depressible button switch.

2. The guardlight according to claim 1, wherein said collar has circumferential grooves for identification by the user, whereby said collar can be pushed forward to expose said depressible button switch.

3. The guardlight according to claim 1, wherein said handle section has parallel grooves on an upper surface which join parallel ridges on a lower surface, whereby a user can readily position the guardlight for defensive operation.

4. The guardlight according to claim 1, wherein said recessed collar section has locking tabs on both sides positioned midway between said lens cover and said handle section, whereby said collar can be locked in a position selected from over said sliding lamp switch and over said depressible button switch.

5. The guardlight according to claim 1, wherein said depressible button switch has a lower block portion having an angled face which cooperates with an angled face of said nozzle means to activate the release of gas from said gas cylinder.

6. The guardlight according to claim 5, wherein said angled faces are angled at 45°.

7. The guardlight according to claim 1, wherein said gas cylinder is enclosed in a holder container.

8. The guardlight according to claim 1, wherein a shoulder guard is positioned at a forward edge and on a bottom surface of said handle section, whereby a user's finger is protected from the gas being ejected from said gas cylinder.

9. The guardlight according to claim 1, wherein said gas cylinder contains a disabling repellent gas.

10. The guardlight according to claim 9, wherein said disabling repellent gas is selected from the group consisting of teargas, carbon disulfide and pepper gas.

11. The guardlight according to claim 10, wherein said disabling repellent gas is teargas.

12. The guardlight according to claim 10, wherein said disabling repellent gas is carbon disulfide.

13. The guardlight according to claim 10, wherein said disabling repellent gas is pepper gas.

14. The guardlight according to claim 1, wherein said gas cylinder contains a gas under pressure which causes a sonic alarm.

15. The guardlight according to claim 14, wherein said gas is carbon dioxide.

16. The guardlight according to claim 1, wherein said lamp switch has a corrugated surface which enables the user to identify said lamp switch by tactile sense.

17. The guardlight according to claim 1, wherein said depressible button switch has a smooth surface which enables the user to identify said depressible button switch by tactile sense.

18. The guardlight according to claim 1, wherein said lamp switch has a corrugated surface, and said depressible button switch has a smooth surface, whereby a user can identify the different switches by tactile sense.

19. The guardlight according to claim 1, wherein said body has an elongated, tubular configuration.

20. The guardlight according to claim 19, wherein said body is generally elliptically shaped in cross-section.

* * * * *